US009120137B2

(12) United States Patent
Zhou et al.

(10) Patent No.: US 9,120,137 B2
(45) Date of Patent: Sep. 1, 2015

(54) STAMPING APPARATUS AND METHOD OF USE

(75) Inventors: Dajun Zhou, Troy, MI (US); Changqing Du, Troy, MI (US); John F. Siekirk, III, Clarkston, MI (US)

(73) Assignee: FCA US LLC, Auburn Hills, MI (US)

( * ) Notice: Subject to any disclaimer, the term of this patent is extended or adjusted under 35 U.S.C. 154(b) by 418 days.

(21) Appl. No.: 13/486,067

(22) Filed: Jun. 1, 2012

(65) Prior Publication Data

US 2013/0319068 A1 Dec. 5, 2013

(51) Int. Cl.
*B21D 22/22* (2006.01)
*B21D 24/04* (2006.01)

(52) U.S. Cl.
CPC ..... *B21D 22/22* (2013.01); *B21D 24/04* (2013.01)

(58) Field of Classification Search
CPC ..... B21D 22/22; B21D 24/04
USPC ..... 72/352, 347–349, 356, 350
See application file for complete search history.

(56) References Cited

U.S. PATENT DOCUMENTS

| | | | | |
|---|---|---|---|---|
| 3,664,172 | A * | 5/1972 | Cvacho | 72/350 |
| 4,373,371 | A | 2/1983 | Liu | |
| 6,196,043 | B1 * | 3/2001 | Ehardt | 72/350 |
| 6,860,135 | B2 * | 3/2005 | Yoshioka et al. | 72/348 |
| 7,322,222 | B2 * | 1/2008 | Kodaka et al. | 72/350 |
| 7,891,226 | B2 | 2/2011 | Seo | |
| 8,056,384 | B2 * | 11/2011 | Schwenk | 72/348 |
| 2007/0186617 | A1 | 8/2007 | Seo | |

FOREIGN PATENT DOCUMENTS

| | | | | |
|---|---|---|---|---|
| DE | 102006047484 | A1 | | 4/2008 |
| EP | 055436 | | | 7/1982 |
| GB | 2238266 | A | | 5/1991 |
| JP | 02037921 | A | * | 2/1990 |
| JP | H08103826 | A | | 4/1996 |
| JP | 2004154786 | A | | 6/2004 |
| JP | 2004160490 | A | | 6/2004 |
| WO | 2005091954 | | | 10/2005 |

OTHER PUBLICATIONS

International Search Report dated Jun. 26, 2013 for International Application No. PCT/US/2013/040503, International Filing Date May 10, 2013.

Written Opinion dated Jun. 26, 2013 for International Application No. PCT/US/2013/040503, International Filing Date May 10, 2013.

* cited by examiner

*Primary Examiner* — Teresa M Ekiert
(74) *Attorney, Agent, or Firm* — Ralph E Smith

(57) ABSTRACT

A stamping apparatus includes a lower die defining a cavity, with a land portion surrounding the cavity. A movable upper die includes a drawing punch that corresponds to the cavity. A binder movable towards the land portion of the lower die engages an edge portion of the blank, wherein the land portion of the lower die and the movable binder each include a plurality of beads that crimp the edge portion of the blank when the movable binder engages the edge portion of the blank. The plurality of beads are oriented orthogonal to a terminal edge of the edge portion. By orienting the plurality of beads in this manner, the crimped edge portion of the blank is allowed to move inboard towards the cavity when the blank is engaged by the drawing punch before being constrained by a throat portion defined by the binder and the lower die.

16 Claims, 5 Drawing Sheets

STAMPING APPARATUS AND METHOD OF USE

FIELD

The present invention relates to stamping dies including a lock-bead for securing the part to be stamped in the stamping die.

BACKGROUND

A stamping apparatus is used to form or "stamp" a metal blank into a finished part that is used for, for example, a panel of a vehicle. To ensure that the metal blank is securely located between upper and lower dies of the stamping apparatus, a binder is engaged to the blank to secure the blank to the lower die before the upper die is actuated to stamp the blank and form the finished part. To ensure that the blank does not move during the stamping process, even when engaged by the binder, the binder may include a bead formed thereon that corresponds to a depression or recess formed in the lower die. Tensile strains experienced by the blank at these locations, however, may cause the blank to break during the stamping process, which may render the finished part unusable.

In addition to single bead configurations, multiple bead configurations are known to more securely clamp the blank before stamping. These multiple bead configurations, however, increase the amount of scrap generated during the stamping process, which increases manufacturing costs. In addition, multiple bead configurations do not ensure that the blank does not break when experiencing tensile strains.

SUMMARY

The present disclosure provides a stamping apparatus for stamping a blank. The stamping apparatus includes a lower die defining a cavity, with a land portion surrounding the cavity. A movable upper die includes a drawing punch that corresponds to the cavity. A binder movable towards the land portion of the lower die engages an edge portion of the blank, wherein the land portion of the lower die and the movable binder each include a plurality of beads that crimp the edge portion of the blank when the movable binder engages the edge portion of the blank. The plurality of beads are oriented orthogonal to a terminal edge of the edge portion. By orienting the plurality of beads in this manner, the crimped edge portion of the blank is allowed to move inboard towards the cavity when the blank is engaged by the drawing punch before being constrained by a throat portion defined by the binder and the lower die.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application, or use. Thus, variations that do not depart from the gist of the invention are intended to be within the scope of the invention.

DETAILED DESCRIPTION

Figure 1:
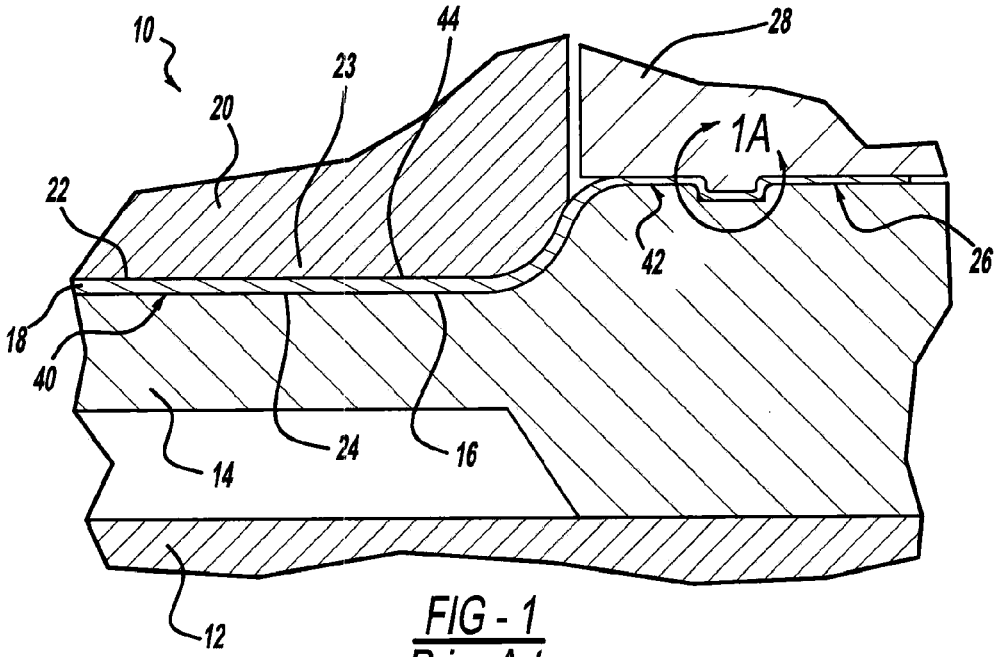
FIG - 1 Prior Art
FIG. 1 is a partial cross-sectional view of a conventional stamping apparatus.

Before describing a stamping apparatus according to the present disclosure, a prior art stamping apparatus will be described with reference to FIG. 1. In general, a stamping apparatus 10 comprises a stationary base member 12 constituted by a bolster plate having a stationary lower or constraining die 14 fixedly supported thereon. Constraining die 14 is formed with an upwardly open cavity 16 that is shaped according to the desired shape of an article to be drawn from a sheet metal blank 18.

Above the constraining die 14 is positioned an upper die 20 that is actuatable downwardly and upwardly by a main hydraulic or mechanical power cylinder (not shown). Upper die 20 has lower surface portion 22 defining a drawing punch 23 correspondingly shaped to a surface 24 that defines cavity 16 formed in constraining die 14. Upper die 20 is thus movable toward and away from cavity 16 in constraining die 14 as upper die 20 is driven to move downwardly and upwardly, respectively, by the main power cylinder. Constraining die 14 has a raised land portion 26 surrounding or juxtaposing cavity 16.

Figure 1A:
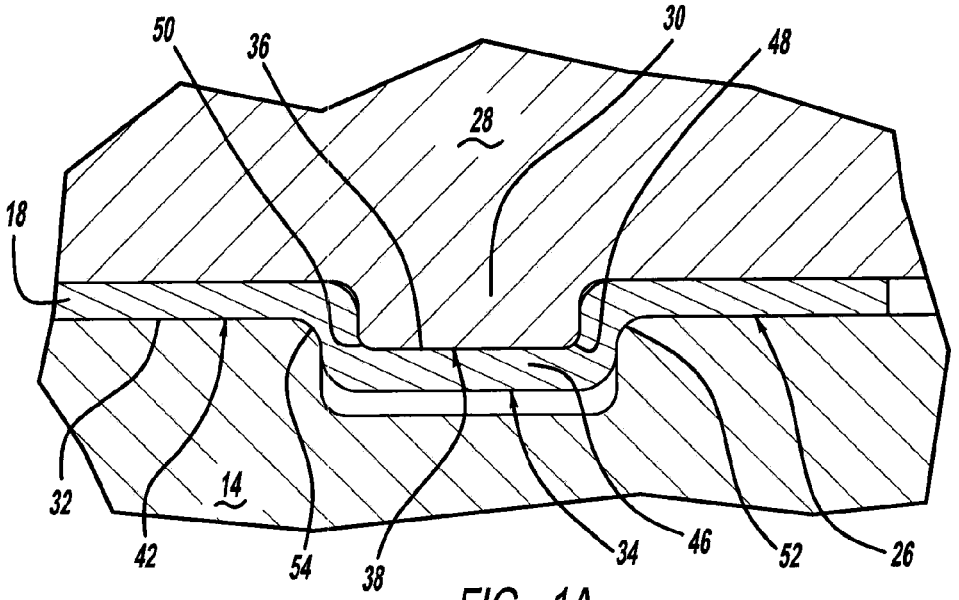
FIG - 1A Prior Art
FIG. 1A is an expanded view of a conventional lock bead configuration illustrated in FIG. 1.

Above land portion 26 of constraining die 14 is positioned a blank-holding binder 28 that is actuatable downwardly and upwardly by an auxiliary power cylinder (not shown). As best shown in FIG. 1A, blank-holding binder 28 defines male draw bead 30, which is thus movable toward and away from land portion 26 of constraining die 14 as blank-holding binder 28 is driven to move downwardly and upwardly, respectively, by the auxiliary power cylinder.

Land portion 26 of constraining die 14 has a flat upper surface 32 constituting a first blank-holding surface extending around or along cavity 16 in constraining die 14 and is formed with a series of upwardly open depressions 34. On the other hand, male draw bead 30 has a flat lower surface 36 constituting a second blank-holding surface that is formed with a series of beads 38 vertically aligned with depressions 34, respectively. Although only a portion of stamping apparatus 10 is illustrated in FIG. 1, it should be understood that beads 38 and depressions 34 may be configured to travel around an entire perimeter of constraining die 14, or be configured to be disposed on either side of cavity 16.

In operation, sheet metal blank 18 is placed on constraining die 14 with a major portion 40 thereof located atop of cavity 16 in constraining die 14 and with an edge portion 42 located atop land portion 26, with the drawing and blank-holding binder 28 and upper die 20 being held in positions above the constraining die 14 (i.e., in a non-stamping position). The main and auxiliary power cylinders (not shown) are then actuated to drive the blank-holding binder 28 and upper die 20 to move downwardly. This causes the drawing punch 23 and the male draw bead 30 to move downwardly toward cavity 16 and land portion 26, respectively, of constraining die 14 and into pressing contact with an upper face 44 of sheet metal blank 18.

Before the drawing punch 23 comes into contact with sheet metal blank 18, male draw bead 30 is brought into pressing contact with sheet metal blank 18 and thereby has blank 18 or, more specifically, edge portion 42 of blank 18 clamped between blank-holding surface 32 of land portion 26 and blank-holding surface 36 of male draw bead 30. As a result, beads 38 of male draw bead 30 force edge portion 42 of blank 18 to partially crowd into depressions 34 in land portion 26. Edge portion 42 of sheet metal blank 18 is then forcefully gripped between blank-holding surfaces 32 and 36 not only by the pressure exerted between surfaces 32 and 36, but effectively by engagement between male draw bead 30 and land portion 26 of constraining die 14 through bead 38 of the former and depressions 34 of the latter.

After sheet metal blank 18 is thus clamped firmly between blank-holding surfaces 32 and 36, drawing punch 23 is brought into pressing engagement with blank 18 and forces blank 18 to stretch into cavity 16 formed in constraining die 14 until blank 18 is forced against surface 24 defining cavity 16. Upon completion of the drawing operation performed as described above, edge portion 42 of blank 18 now having a series of crimps 46 formed in edge portion 42 is cut off from blank 18. An article (not shown) such as, for example, a side panel of a vehicle that is shaped conformingly to cavity 16 in constraining die 14 is thus obtained.

A drawback of the prior art stamping apparatus 10 described above includes that sheet metal blank 18 experiences tensile strains at edge portion 42 of blank 18 in lateral directions at positions that correspond to bead 38 of blank-holding binder 28 and depressions 34 formed in constraining die 14. In particular, referring to FIG. 1A, bead 38 includes corners 48 and 50 and depression 34 includes corners 52 and 54. When bead 38 is actuated toward depression 34 during actuation of blank-holding binder 28 to form blank-holding crimp 46 in blank 18, as noted above, upper die 20 is actuated to draw and form blank 18 between drawing punch 23 and cavity 16 to form the completed stamped part.

During the stamping process, edge portion 42 of blank 18 is drawn toward cavity 16, but is retained due to engagement between male draw bead 30 and land portion 26. Due to edge portion 42 being drawn toward cavity 16 and being retained between male draw bead 30 and land portion 26, blank 18 experiences elevated tensile strains in a lateral direction (i.e., to the left in the figure), which are exacerbated at locations of corners 48, 50, 52, and 54. In particular, blank 18 experiences the most tensile strain at corner 54 of depression 34. Due to the elevated tensile strains in the lateral direction at corner 54, blank 18 may break, which may cause the part to be drawn further into cavity 16 than desired, which results in an incorrectly stamped part that requires it to be discarded. Discarding the incorrectly stamped part increases material costs, which drives up manufacturing costs associated with manufacturing stamped parts.

In addition, notwithstanding the clamping force exerted by bead 38 and depression 34 on blank 18 during the drawing process, blank 18 may stretch due to the tensile strength of the material forming blank 18. After drawing punch 23 is actuated upwards away from constraining die 14, the material forming blank 18 may spring back. "Springback" is a condition that occurs when a blank is stamped and upon release of the drawing force, the material has a tendency to partially return to its original shape because of the elastic recovery of the material. This is influenced not only by the tensile and yield strengths of the material, but also by material thickness, bend radius, and bend angle. It is desirable to eliminate, or least substantially minimize, springback as much as possible to ensure that the final stamped part conforms to the desired specifications.

Figure 2:
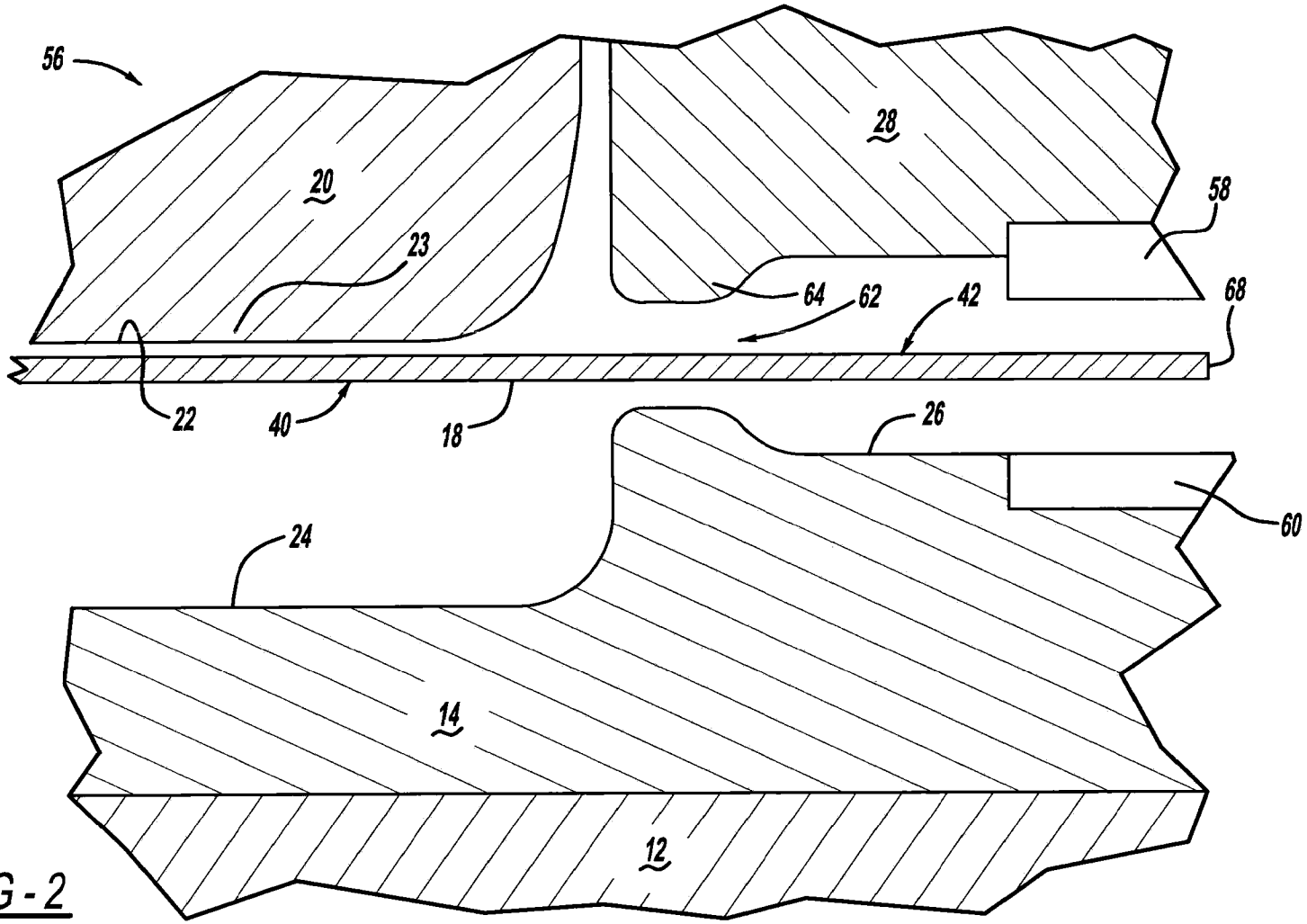
FIG. 2 is a partial cross-sectional view of a stamping apparatus according to the present disclosure.

To reduce springback, the present disclosure provides a stamping apparatus that substantially minimizes the tensile strains experienced during drawing and forming of blank 18 into a finished stamped part. Now referring to FIG. 2, the present disclosure provides a stamping apparatus 56 that, similar to prior art stamping apparatus 10, includes support member 12, constraining die 14, an upper die 20, and a blank-holding binder 28. Constraining die 14 also includes land portion 26. Stamping apparatus 56 differs from prior art stamping apparatus 10 in that holding punch 30 and depression 34 formed in blank-holding binder 28 and land 26, respectively, are replaced by a plurality of wrinkle beads 58 and 60.

Wrinkle beads 58 formed in blank-holding binder 28 correspond and engage with wrinkle beads 60 formed in land 26 of constraining die 14 with blank 18 disposed therebetween. Inboard (i.e., in a direction toward cavity 16) from wrinkle beads 58 and 60 may be formed a throat portion 62. Throat portion 62 may be comprised of projections 64 and 66 formed on blank-holding binder 28 and lower die 14, respectively.

During the drawing process, wrinkle beads 58 and 60 will crimp blank 18 in a manner that allows terminal edges 68 of blank 18 to travel inboard (i.e., in a direction toward cavity 16). Once the crimped blank 18 reaches throat portion 62, however, the crimped blank 18 will be restrained through engagement of the crimps formed in blank 18 with throat portion 62, as will be explained in more detail below.

Figure 3:
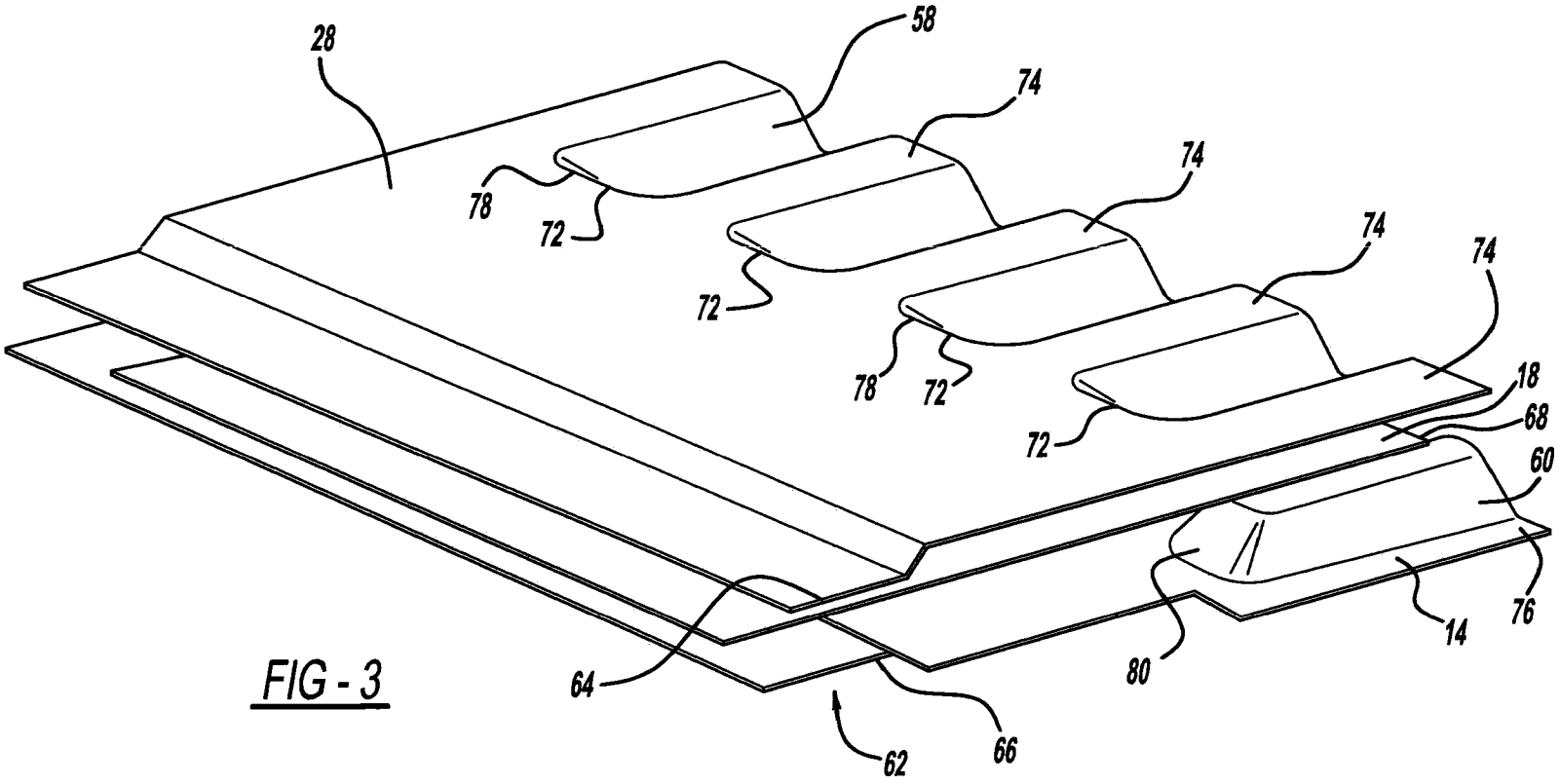
FIG. 3 is a perspective view of a bead configuration according to the present disclosure.
Figure 4:
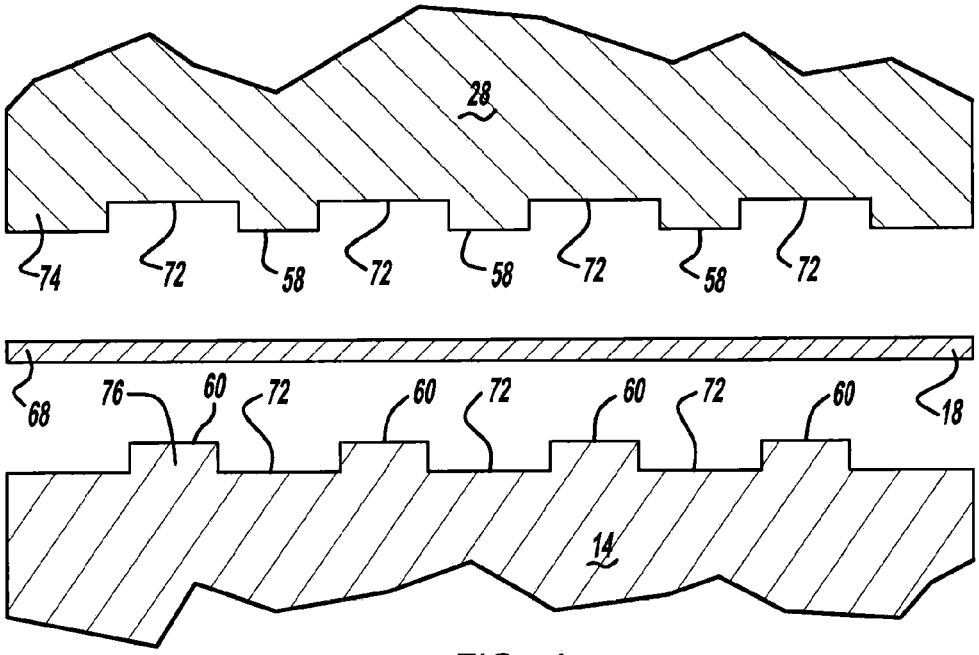
FIG. 4 is a side-perspective view of a binder and constraining die having a bead configuration according to the present disclosure.
Figure 5:
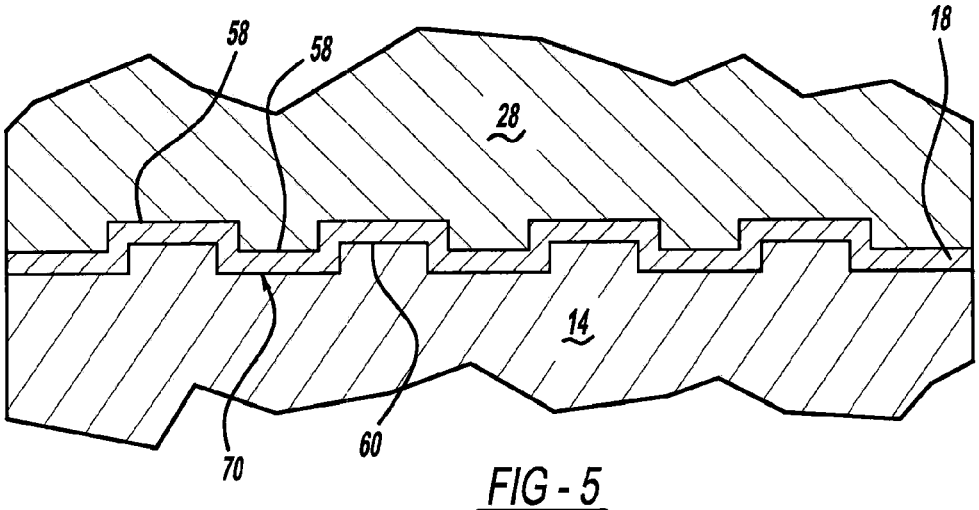
FIG. 5 is a side-perspective view of a binder and a constraining die having a bead configuration according to the present disclosure crimping a blank to be stamped.
Figure 6:
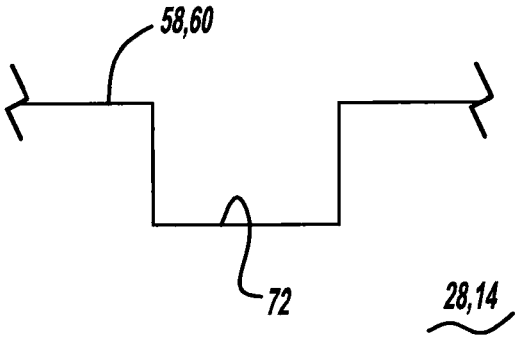
FIGS. 6 to 9 are side-perspective views of a binder and/or a constraining die illustrating different shapes of concavities that form beads according to the present disclosure.
Figure 7:
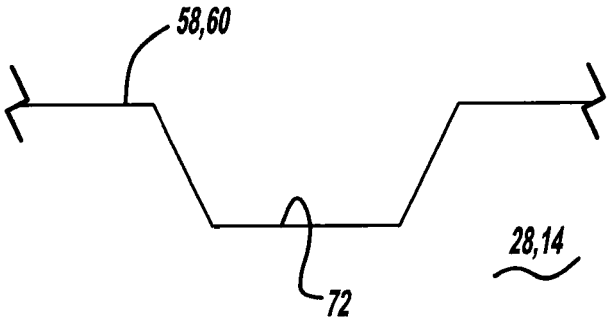
Figure 8:
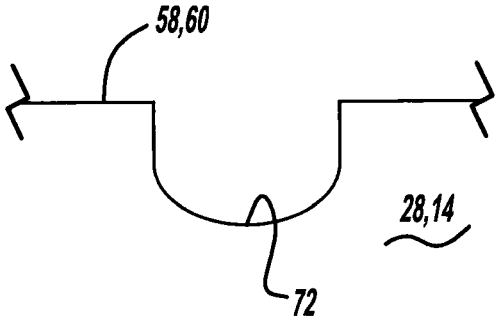
Figure 9:
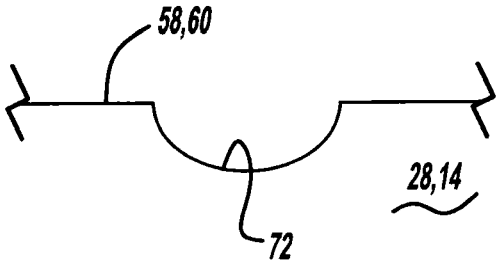

Referring to FIG. 3, it can be seen that wrinkles 58 and 60 are arranged orthogonal to terminal edge 68 of blank 18. When wrinkle beads 58 and 60 are arranged orthogonal to terminal edge 68 of blank 18 and engage blank 18 to form a crimped portion 70 (FIG. 5), less restraining force is exerted on blank 18 compared to a configuration like that illustrated in FIG. 1 where bead 38 is arranged parallel to terminal edge 68 of blank 18. This lower amount of restraining force exerted on blank 18 by wrinkle beads 58 and 60 allows terminal edge 68 of blank 18 to be pulled toward cavity 16 when upper die 20 is actuated toward cavity 16 and engages blank 18. Although crimped portion 70 is pulled toward cavity 16 during drawing of the blank by upper die 20, once crimped portion 70 reaches throat portion 62, the crimped portion 70 is restrained by throat portion 62. That is, wrinkle beads 58 and 60 have a height greater than that of projections 64 and 66, which form throat portion 62. Accordingly, the crimped portion 70 will be restrained by throat portion 62 when crimped portion 70 reaches throat portion 62. Once restrained by throat portion 62, crimp portion 70 and terminal edge 68 of blank 18 are prevented from being pulled into cavity 16 by drawing punch 23.

Further, by forming crimped portion 70 in blank 18 using wrinkle beads 58 and 60 and initially allowing crimped portion 70 of blank 18 to be pulled toward cavity 16 during drawing of the blank 18, springback of blank 18 is reduced. Springback is reduced because although blank 18 is gripped by wrinkle beads 58 and 60 with a sufficient force to provide crimped portion 70, the force exerted on blank 18 by wrinkle beads 58 and 60 is not to an extent that prevents crimped portion of blank 18 from being pulled toward cavity 16. The post-forming stretch of blank 18, however, is not to an extent that a significant amount of springback will occur once the drawing force exerted on blank 18 by upper die 20 is removed. Further, by placing throat portion 62 inboard from wrinkle beads 58 and 60, blank 18 is allowed to elastically deform to an extent such that when throat portion 62 restrains passage of crimped portion 70, drawing of blank 18 by upper die 20 is nearly complete. By restraining movement of blank 18 near completion of the drawing process, the elastic recovery of the material forming blank 18 is minimized, which reduces the amount of springback experienced upon release of upper die 20.

Wrinkle beads 58 and 60 are best shown in FIG. 3. Wrinkle beads 58 and 60 can be formed in the shape of elongate concavities 72. Each concavity can be separated by a land 74. In some embodiments, concavities 72 can be formed along an entire length of blank holding binder 28, as well as along an entire length of constraining die 14. In other embodiments, concavities 72 can be formed only along a predetermined length of blank holding binder 28 and constraining die 14. In this regard, groups of concavities 72 can be formed in various positions on both blank holding binder 28 and constraining die 14. For example, groups of concavities 72 can be formed along a center portion of blank holding binder 28 and constraining die 14, or groups of concavities 72 can be formed at edge portions of blank holding binder 28 and constraining die 14. Regardless, it should be understood that a plurality of concavities 72 should be formed on blank holding binder 28 and constraining die 14 in a sufficient number to ensure that as crimped portion 70 travels toward throat portion 62, sufficient resistance is provided that prevents further travel of terminal edges 68 of blank 18 towards cavity 16.

Concavities 72 can be formed on both blank holding binder 28 and constraining die 14 to extend between edge 74 and 76 thereof and position 78 and 80 located inboard from edge 74 and 76. Alternatively, an entire length of concavity 72 can be formed at a portion inboard from the edge 74 and 76. A length of each concavity 72 is variable. In this regard, concavities 72 can have a length of one to two inches, or concavities 72 can have a length between one to four inches, inclusive. A depth of each concavity 72 is also variable. The depth of each concavity 72 can range between 0.125 and 0.5 inches, inclusive. A width of each concavity 72 is also variable. Depending on a length of concavity 72, a width of concavity 72 can range between 0.25 and one inch. One skilled in the art will readily acknowledge and appreciate, however, that concavities 72 can have any length, width, and depth necessary to ensure sufficient gripping force is achieved between throat portion 62 and crimped portion 70 as terminal edge 68 of blank 18 is pulled toward cavity 16.

Concavities 72 should be shaped such that after crimped portion 70 is formed, and terminal edge 68 of blank 18 begins to be pulled toward cavity 16 as drawing ram 23 engages blank 18, the crimped material is easily released from concavities 72. As best illustrated in FIG. 3, it can be seen that concavities 72 at the positions 78 and 80 inboard from edges 74 and 76 of blank holding ram 28 and constraining die 14 are formed to be bullet-shaped. More specifically, concavities 72 can be shallower at the position 78 and 80 inboard relative to the depth of the concavities 72 at a position closer to edges 74 and 76 of the blank-holding ram 28 and constraining die 14. By making the depth of the concavity 72 at the positions 78 and 80 inboard less than the depth of the concavity 72 at other positions (e.g., near edges 74 and 76), the material of the blank 18 that is deformed by the wrinkle beads 58 and 60 can more easily be pulled out of the concavities 72 and toward cavity 16 during drawing of blank 18.

As best shown in FIGS. 6-9, cross-sectional shapes of concavities 72 can vary. In some exemplary embodiments, a cross-section of concavities 72 can be square or rectangular (e.g., FIG. 6). In other exemplary embodiments, a cross-section of concavities 72 can be trapezoidal (e.g., FIG. 7), round (e.g., FIG. 8), or oval (e.g., FIG. 9). One skilled in the art will readily acknowledge and appreciate, however, that concavities 72 can have any cross-sectional shape desired so long as the material of blank 18 is easily movable from concavity 72 after crimped portion 70 is formed, and pulled toward cavity 16 as the drawing process commences.

What is claimed is:

1. A stamping apparatus for stamping a blank, comprising:

a lower die defining a cavity, the lower die including a land portion surrounding the cavity;

a movable upper die including a drawing punch that corresponds to the cavity; and a binder movable towards the land portion of the lower die for engaging an edge portion of the blank, wherein the land portion of the lower die and the movable binder each include a plurality of beads that crimp the edge portion of the blank when the movable binder engages the edge portion of the blank to form a crimped portion, the plurality of beads being oriented orthogonal to a terminal edge of the edge portion;

the land portion of the lower die and the movable binder each include a projection formed directly opposite from each other, inboard from the plurality of beads, and directly adjacent to the cavity, the projections of the lower die and binder collectively defining a throat portion when the binder is engaged with the blank that, as the edge portion of the blank is drawn towards the cavity by the drawing punch, engages with and restrains movement of the crimped portion towards the cavity.

2. The stamping apparatus of claim 1, wherein a height of the beads is greater than a height of the projections that define the throat portion.

3. The stamping apparatus of claim 1, wherein the orientation of the plurality of beads allows the crimped portion of the blank to move inboard towards the cavity when the blank is engaged by the drawing punch.

4. The stamping apparatus of claim 1, wherein the beads are defined by elongate cavities formed in each of the lower die and the binder.

5. The stamping apparatus of claim 4, wherein the elongate cavities are bullet-shaped.

6. The stamping apparatus of claim 4, wherein a shape of the elongate cavities allows the crimped portion of the blank to move inboard towards the cavity when the blank is engaged by the drawing punch.

7. A method of stamping a blank, comprising:

crimping an edge portion of the blank with a plurality of beads formed on each of a first stamping member and a second stamping member to form a crimped edge portion, the plurality of beads each being oriented orthogonal to a terminal edge of the edge portion; and drawing a central portion of the blank with a drawing member that corresponds to a cavity formed in the second stamping member, wherein during the drawing step, the crimped edge portion is pulled inboard towards the cavity despite engagement with the plurality of beads before being constrained by engagement with a throat portion defined by the first stamping member and the second stamping member; and wherein the first stamping member and the second stamping member each include a projection formed inboard from the plurality of beads and directly adjacent to the cavity, the projections being formed directly opposite from each other and collectively defining the throat portion.

8. The method of claim 7, wherein a height of the beads is greater than a height of the projections that define the throat portion.

9. The method of claim 7, wherein the orientation of the plurality of beads allows the crimped edge portion of the blank to move inboard towards the cavity during the drawing step.

10. The method of claim 7, wherein the beads are defined by elongate cavities formed in each of the first and second stamping members.

11. The method of claim 10, wherein the elongate cavities are bullet-shaped.

12. The method of claim 10, wherein a shape of the elongate cavities allows the crimped edge portion of the blank to travel inboard during the drawing step.

13. The stamping apparatus of claim 1, wherein the plurality of beads that crimp the edge portion of the blank are defined by a plurality of elongate concavities separated by lands, the elongate concavities of the lower die corresponding to and engaging with the lands of the movable binder.

14. The stamping apparatus of claim 1, wherein the crimped edge portion is non-planar.

15. The method of claim 7, wherein the plurality of beads that crimp the edge portion of the blank are defined by a plurality of elongate concavities separated by lands, the elongate concavities of the first stamping member corresponding to and engaging with the lands of the second stamping member.

16. The method of claim 7, wherein the crimped edge portion is non-planar.

* * * * *